US005117666A

United States Patent [19]

Keefer

[11] Patent Number: 5,117,666

[45] Date of Patent: Jun. 2, 1992

[54] KEY SUPPORT APPARATUS

[76] Inventor: Robert E. Keefer, 12325 Punchbowl Rd., Mercesburg, Pa. 17236

[21] Appl. No.: 756,512

[22] Filed: Sep. 9, 1991

[51] Int. Cl.[5] ..... A44B 15/00

[52] U.S. Cl. ..... 70/456 R

[58] Field of Search ..... 70/456 R–459

[56] References Cited

U.S. PATENT DOCUMENTS

| | | | |
|---|---|---|---|
| 2,595,981 | 5/1952 | Prickett et al. | 70/456 R |
| 2,657,569 | 11/1953 | Hill | 70/456 R |
| 2,795,128 | 6/1957 | Ly | 70/456 R |
| 2,822,684 | 2/1958 | Ray | 70/456 R |
| 3,079,784 | 3/1963 | Pavlowski | 70/456 R |
| 3,173,280 | 3/1965 | Oberacker | 70/456 R |
| 3,436,942 | 4/1969 | Procter | 70/456 R |
| 3,457,746 | 7/1969 | Glassman | 70/456 R |
| 3,672,192 | 6/1972 | Dontas | 70/456 R X |
| 3,696,649 | 10/1972 | Chow et al. | 70/456 R |
| 3,827,263 | 8/1974 | Starrett | 70/456 R |
| 4,045,984 | 9/1977 | McDonald | 70/456 R |
| 4,253,321 | 3/1981 | Sorensen | 70/456 R X |
| 4,524,594 | 6/1985 | Bascou | 70/456 R |
| 4,646,913 | 3/1987 | Wing et al. | 70/456 R X |
| 4,660,397 | 4/1987 | Girimont | 70/456 R |
| 4,888,970 | 12/1989 | Kinzler et al. | 70/456 R |

*Primary Examiner*—Renee S. Luebke
*Assistant Examiner*—Suzanne L. Dino
*Attorney, Agent, or Firm*—Leon Gilden

[57] ABSTRACT

A housing includes a top and bottom plate in a spaced parallel coextensive relationship integrally secured together pivotally mounting a first and second key holder at opposed ends of the plate, wherein the key holder includes pivotal axles orthogonally oriented to each of the plates and parallel relative to one another. The key holders are spring biased for rotation between the plates and are maintained in a first position by a latch mechanism and released to a second position upon release of the latch mechanism to include a lever, with a lever engaging a projection in a respective key holder.

3 Claims, 6 Drawing Sheets

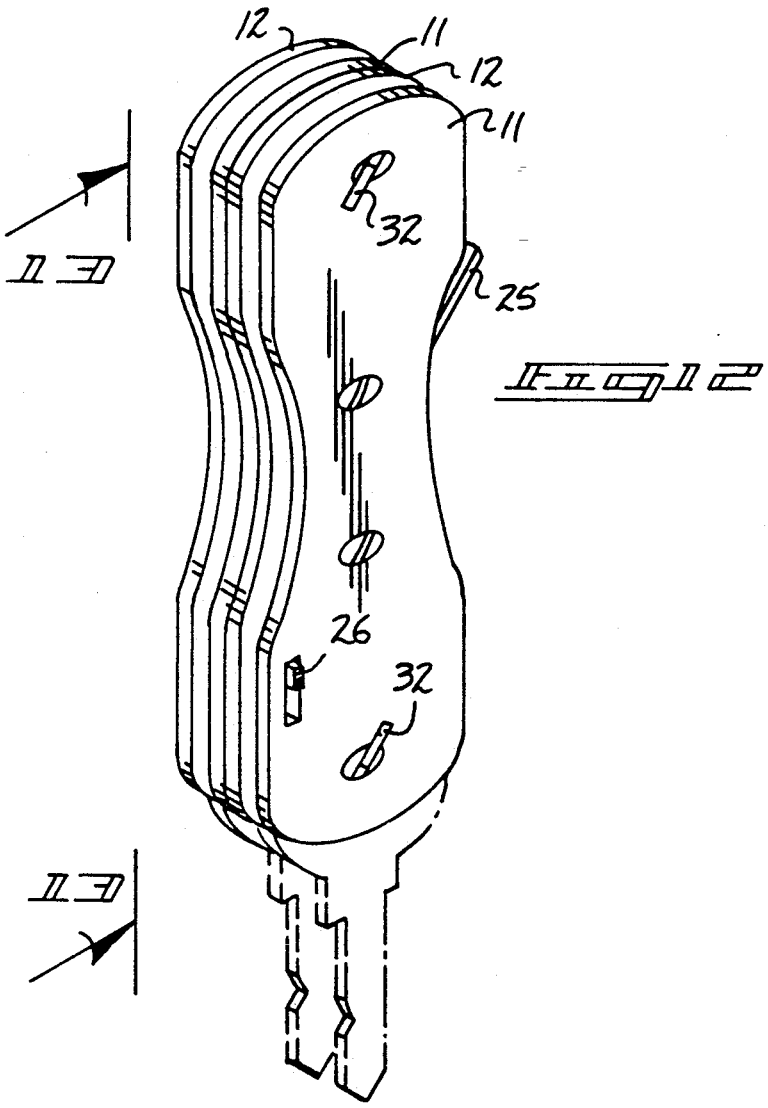
Fig 12
Fig 13
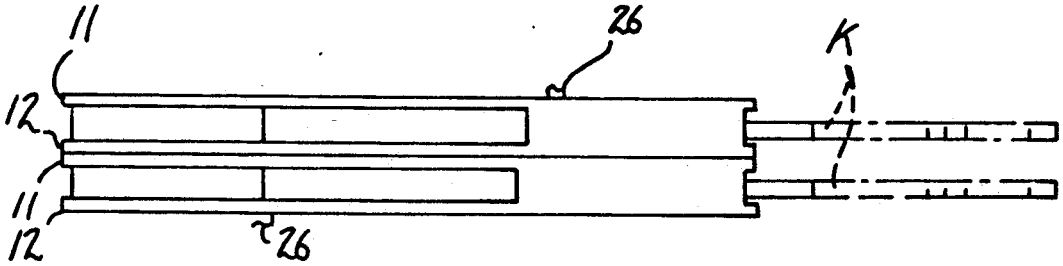

KEY SUPPORT APPARATUS

BACKGROUND OF THE INVENTION

1. Field of the Invention

The field of invention relates to key holder apparatus, and more particularly pertains to a new and improved key support apparatus wherein the same utilizes a plurality of opposed key holder members biased to project an associated key contained within each key holder exteriorly of an associated housing.

2. Description of the Prior Art

Various key holder apparatus is utilized in the prior art to support a key member therewithin. Such key holder apparatus is typically of a cumbersome structure relative to the instant invention, and are exemplified by U.S. Pat. No. 2,822,684 to Ray wherein a key holder utilizes a plurality of adjacent key members mounted in a biased position relative to opposed plates within the holder.

U.S. Pat. No. 4,524,594 to Bascou provides for a housing to bias a key relative to the housing.

U.S. Pat. No. 3,318,354 to Borisol sets forth a key case hingedly mounting a plurality of keys therewithin.

U.S. Pat. No. 4,646,913 to Wing, et al. sets forth a key pack for mounting a plurality of keys in an opposed relationship within a housing utilizing a spring member to bias each key relative to the housing.

As such, it may be appreciated that there continues to be a need for a new and improved key support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of key holder apparatus now present in the prior art, the present invention provides a key support apparatus wherein the same pivotally mounts a plurality of keys in a biased relationship relative to a housing to selectively project each key relative to the housing. As such, the general purpose of the present invention, which will be described subsequently in greater detail, is to provide a new and improved key support apparatus which has all the advantages of the prior art key holder apparatus and none of the disadvantages.

To attain this, the present invention provides a housing including a top and bottom plate in a spaced parallel coextensive relationship integrally secured together pivotally mounting a first and second key holder at opposed ends of the plate, wherein the key holder includes pivotal axles orthogonally oriented to each of the plates and parallel relative to one another. The key holders are spring biased for rotation between the plates and are maintained in a first position by a latch mechanism and released to a second position upon release of the latch mechanism to include a lever, with a lever engaging a projection in a respective key holder.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved key support apparatus which has all the advantages of the prior art key holder apparatus and none of the disadvantages.

It is another object of the present invention to provide a new and improved key support apparatus which may be easily and efficiently manufactured and marketed.

It is a further object of the present invention to provide a new and improved key support apparatus which is of a durable and reliable construction.

An even further object of the present invention is to provide a new and improved key support apparatus which is susceptible of a low cost of manufacture with regard to both materials and labor, and which accordingly is then susceptible of low prices of sale to the consuming public, thereby making such key support apparatus economically available to the buying public.

Still yet another object of the present invention is to provide a new and improved key support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 12 is an isometric illustration of the invention utilizing the axle support pin of FIG. 11 to mount a plurality of housings in a contiguous relationship.

FIG. 13 is an orthographic view, taken along the lines 13—13 of FIG. 12 in the direction indicated by the arrows.

DESCRIPTION OF THE PREFERRED EMBODIMENT

Figure 1:
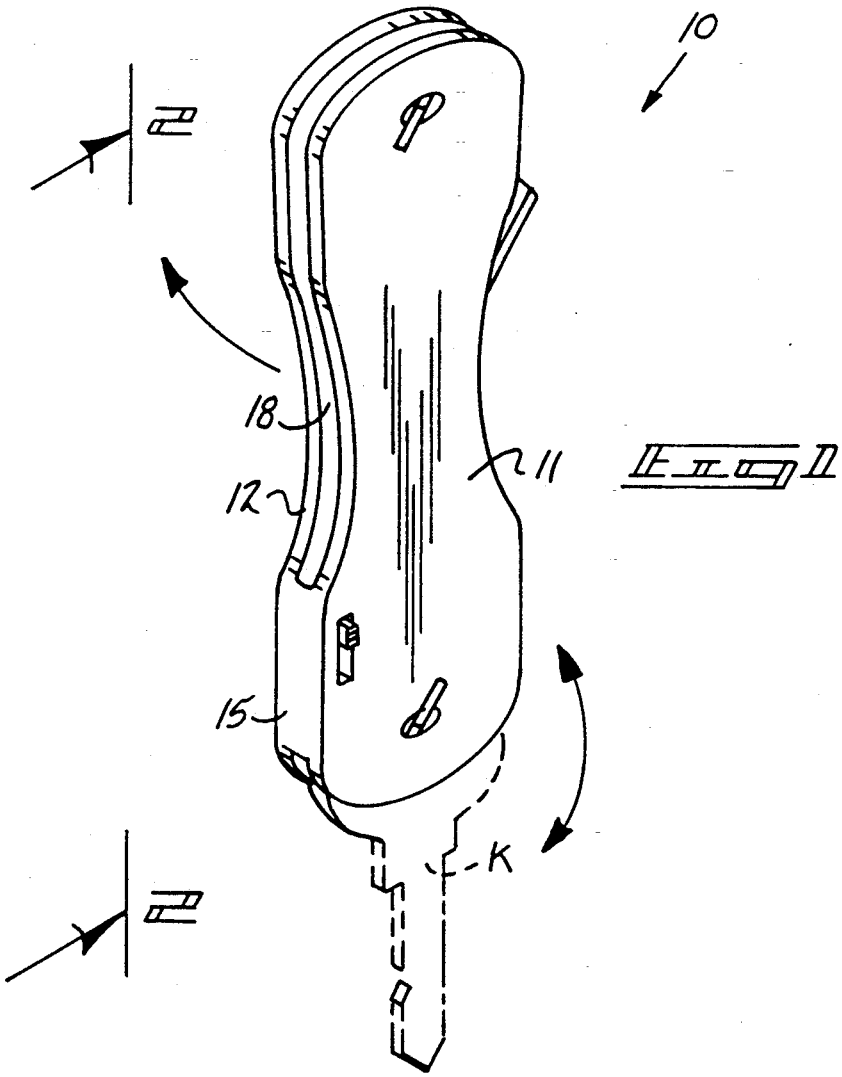
FIG. 1 is an isometric illustration of the instant invention.
Figure 2:
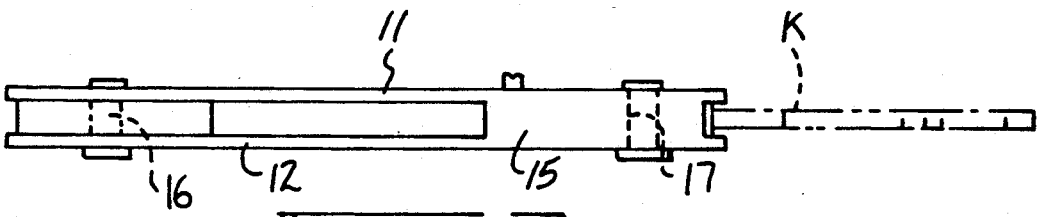
FIG. 2 is an orthographic side view, taken along the lines 2—2 of FIG. 1 in the direction indicated by the arrows.
Figure 4:
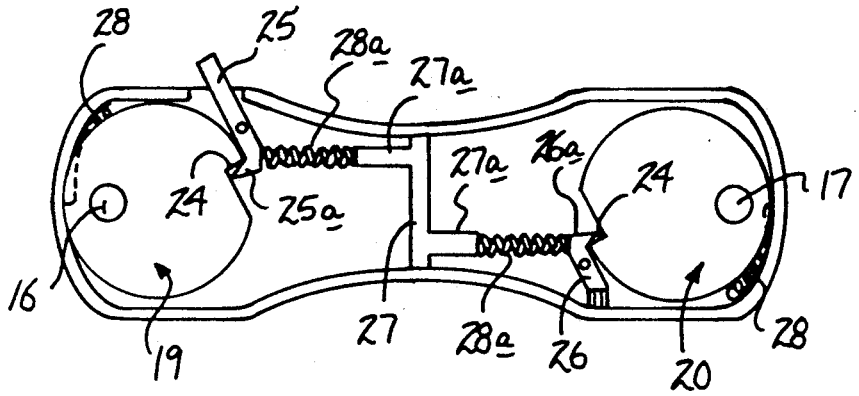
FIG. 4 is an orthographic view, taken along the lines 4—4 of FIG. 3 in the direction indicated by the arrows.
Figure 3:
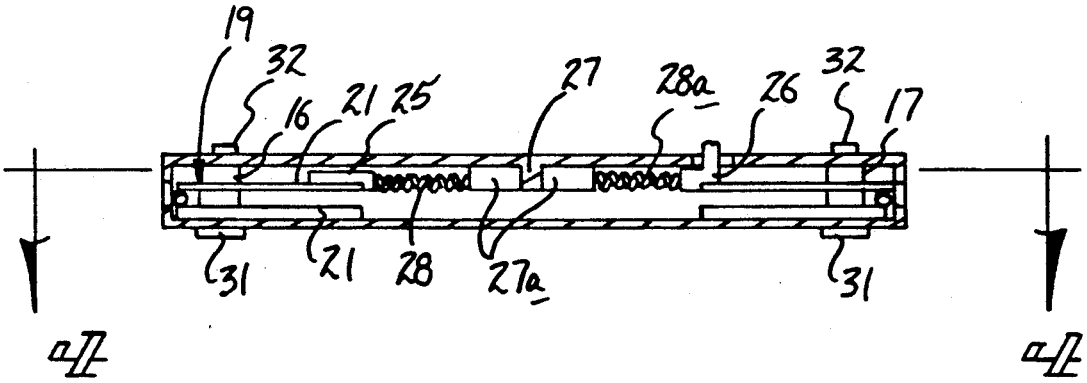
FIG. 3 is a cross-sectional end view of the instant invention.
Figure 5:
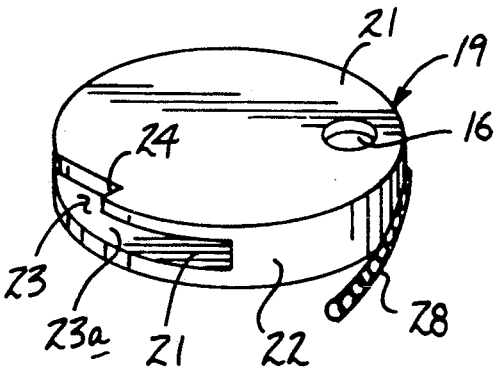
FIG. 5 is an isometric illustration of the key holder utilized by the instant invention.
Figure 6:
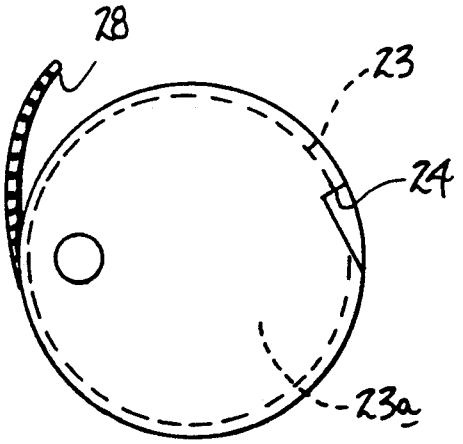
FIG. 6 is an orthographic top view of the key holder of the invention.
Figure 7:
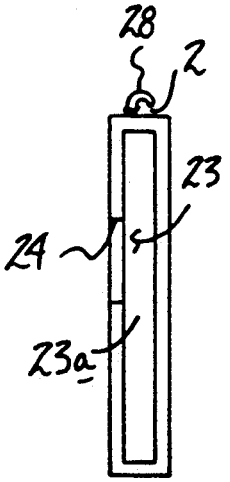
FIG. 7 is an orthographic side view of the key holder member of the invention.
Figure 8:
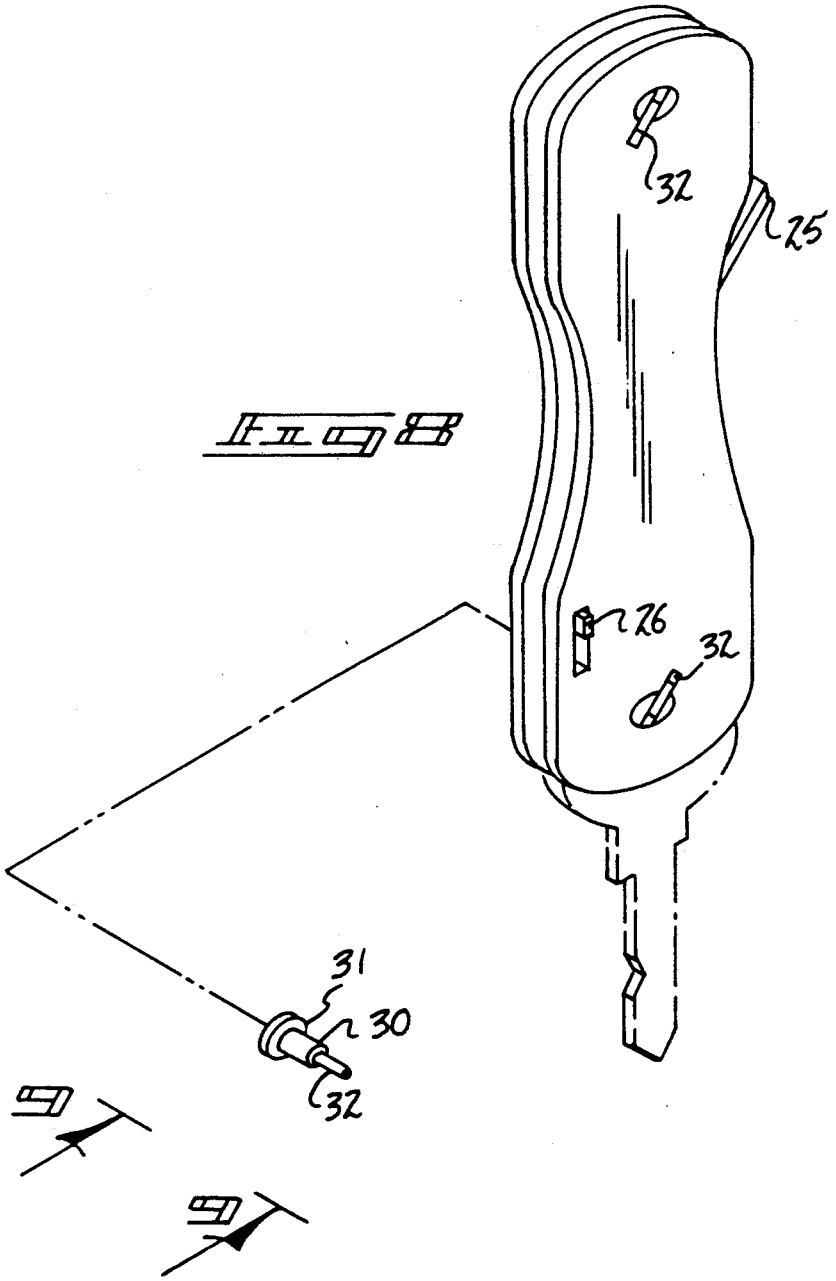
FIG. 8 is a further isometric illustration of the invention illustrating the axle pin support structure.
Figure 9:
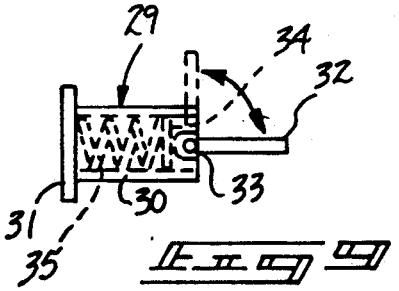
FIG. 9 is an orthographic view of the support pin, taken along the lines 9—9 of FIG. 8 in the direction indicated by the arrows.
Figure 10:
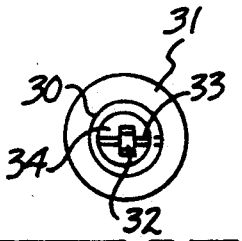
FIG. 10 is an orthographic end view of the axle support pin.

With reference now to the drawings, and in particular to FIGS. 1 to 16 thereof, a new and improved key support apparatus embodying the principles and concepts of the present invention and generally designated by the reference numeral 10 will be described.

More specifically, the key support apparatus 10 of the instant invention essentially comprises a first housing plate 11 spaced from, parallel to, and coextensive with a second housing plate 12 to define a spacing therebetween. A first and second pivot axle 16 and 17 each include a pivot axle pin 29 (see FIG. 9 for example) to pivotally mount a respective first and second key holder 19 and 20 between the first and second housing plates 11 and 12. At least one connecting web 15 is fixedly mounted between the first and second housing plates 11 and 12 to fixedly mount the housing plates together, with spaced slots 18 projecting through opposed sides of the housing defined by the first and second housing plates 11 and 12. Each key holder is defined by spaced cylindrical disks 21 secured together by a connecting web 22 (see FIG. 5) to define an entrance slot 23 into the housing cavity 23*a* to secure a key "K" therewithin. Each upper disk of the spaced disks 21 includes a locking notch 24 positioned above the slot 23. A respective first and second latch lever 25 and 26 each include a respective first and second engagement projection 25*a* and 26*a* for projection within the locking notch 24. Pivotment of each respective lever and a respective engagement projection permits separation of the projection relative to the notch and pivotment of the associated key holder within the housing effected by rotation of a key holder biasing spring 28, wherein one end of the biasing spring 28 is mounted to the key holder adjacent a respective pivot axle bore 16 that receives the pivot axle pin 29 therethrough, with an opposing end of the key holder biasing spring 28 mounted within the housing.

Each respective first and second latch levers 25 and 26, as illustrated for pivotment within the housing about a respective axle, and may project laterally of the housing or project orthogonally through a top plate, as illustrated by the lever 26. Further, a central housing rib 27 is directed parallel between the first and second pivot axle openings 16 and 17, wherein the central housing rib 27 includes a plurality of spring mounting ribs 27*a*, wherein each of the ribs 27*a* projects orthogonally relative to the central housing rib 27 to mount a latch spring 28*a* between the spring mounting rib 27*a* and an associated latch lever in alignment with the engagement projection 25*a* and 26*a* of the respective first and second levers 25 and 26.

Figure 11:
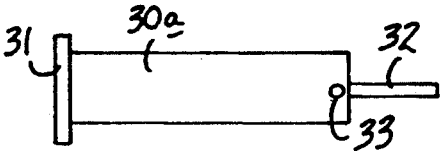
FIG. 11 is an orthographic side view of an elongate axle support pin.

Each pivot axle pin 29 includes a cylindrical tubular shank 30 for projection through the respective axle openings 16 and 17, with a planar head 31 fixedly and orthogonally mounted to a first end of the cylindrical shank 30, with a locking leg 32 pivotally mounted to an opposed end of the cylindrical tubular shank 30. The locking pin 32 is pivotally mounted about a locking leg pivot 33 that in turn is mounted to a spring plate 34. The spring plate 34 and the planar head 31 capture a spring plate spring member 35 therebetween. Further, the predetermined length defined between the first and second housing plates 11 and 12 is substantially equal to the cylindrical tubular shank axial length to permit projection of the shank through each respective pivot axle opening. It should be noted, as illustrated in FIG. 11, that a modified cylindrical tubular shank 30*a* is provided defined by twice the predetermined spacing to permit securement of a plurality of housing defined by first and second housing plates 11 and 12 together, as illustrated in FIGS. 12 and 13.

Figure 14:
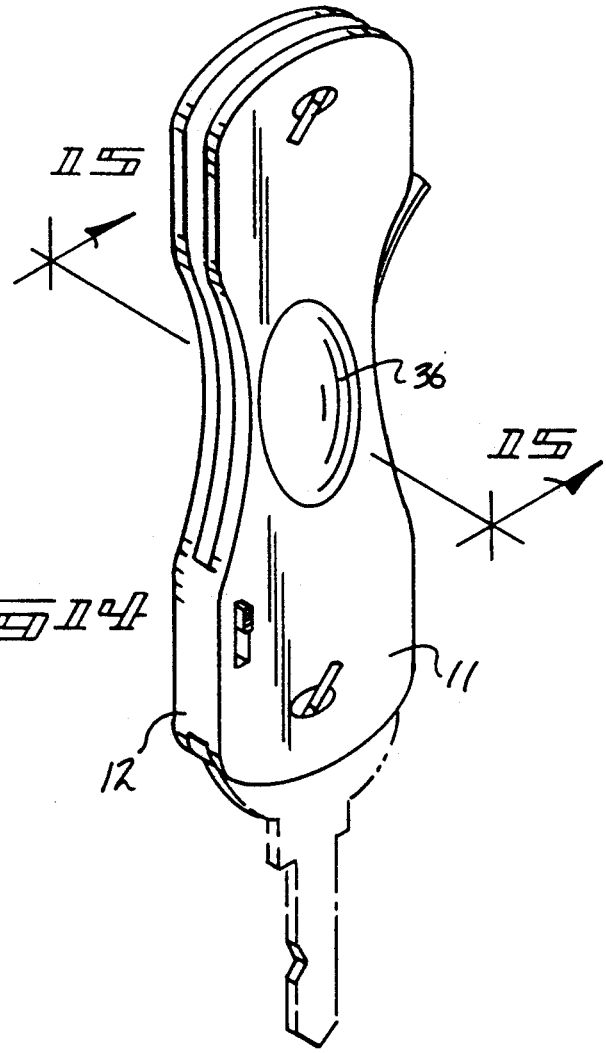
FIG. 14 is an isometric illustration of a further modification of the invention.

FIG. 14 illustrates a modified first housing plate 11 that includes a flexible housing 36 mounted thereto, wherein the flexible housing 36 contains a graphite powder 37 between the flexible housing 36 and the first housing plate 11. A nozzle 39 projects through the first housing plate in communication interiorly of the flexible housing 36 to direct graphite powder 37 into the housing cavity 38 between respective key holders to effect lubrication within the key holder minimizing binding within the housing of a key member "K" therewithin.

Figure 16:
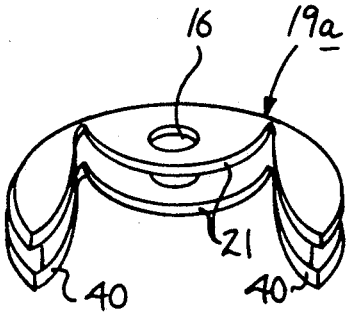
FIG. 16 is an isometric illustration of a modified key holder member utilized by the invention.
Figure 15:
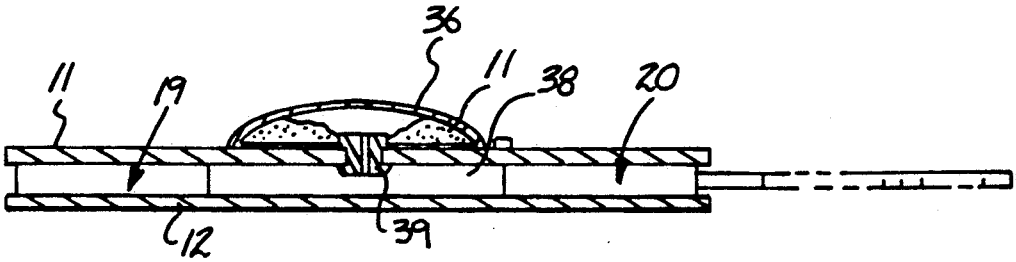
FIG. 15 is an orthographic view, taken along the lines 15—15 of FIG. 14 in the direction indicated by the arrows.

FIG. 16 illustrates a modified key holder 19*a*, wherein a plurality of key holder ears 40 are biased towards one another to secure a key member between the ears and secure the key holder within the slot defined between the top and bottom disks 21.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A key support apparatus, comprising, a first housing plate in a spaced parallel coextensive relationship relative to a second housing plate, wherein the first housing plate and the second housing plate include at least one connecting web to fixedly secure the first and second housing plates together defining a predetermined spacing, and first pivot means and second pivot means orthogonally directed through the first housing plate and the second housing plate, wherein the first pivot means and the second pivot means are in a spaced parallel relationship at opposed ends of the first housing plate and the second housing plate for mounting a respective key within a housing cavity defined between the first housing plate and the second housing plate, and a first key holder mounted about the first pivot means, and a second key holder mounted about the second pivot means, and first spring means for biasing the first key holder rotatably about the first pivot means, and second spring means for pivotally mounting the second key holder about the second pivot means, and each key holder includes a plurality of spaced cylindrical disks secured together by a disk connecting web, and an entrance slot directed between the disks diametrically opposed to the disk connecting web, and a pivot axle opening orthogonally directed through the disks for receiving the pivot means, and the pivot axle opening positioned adjacent the connecting web, and each key holder includes a locking notch formed within one of the spaced cylindrical disks adjacent the entrance slot, and each locking notch includes a locking lever in biased engagement with the locking notch, and a central housing rib is mounted within the housing cavity arranged parallel to and medially of the first and second pivot means, and the central housing rib includes a plurality of spring mounting ribs orthogonally oriented relative to the housing rib, and each spring mounting rib includes a latch spring means for biasing a respective latch lever in engagement with a respective locking notch of each key holder.

2. An apparatus as set forth in claim 1 wherein each pivot means includes a cylindrical tubular shank defined by a predetermined length equal to the predetermined spacing between the first housing plate and the second housing plate, and a planar head mounted at a first end of the tubular shank, and a locking leg pivotally mounted at a second end of the tubular shank, and the locking leg including a locking leg pivot, the locking leg pivot pivotally mounted to a spring plate, and a spring plate spring member captured between the spring plate and the planar head.

3. An apparatus as set forth in claim 2 wherein the first housing plate includes a flexible housing mounted medially of and fixedly mounted to a top surface of the first housing plate, and the flexible housing including a powdered graphite contained within the flexible housing, and a nozzle projecting through the first housing plate in communication within the flexible housing for directing the graphite powder into the housing cavity.

* * * * *